US005428322A

United States Patent [19]

Hendrick et al.

[11] Patent Number: 5,428,322

[45] Date of Patent: Jun. 27, 1995

[54] MICROWAVE WAVEGUIDE MULTIPLEXER

[75] Inventors: Louis W. Hendrick, Hermosa Beach; Krishnan Raghavan; Craig N. Schwartz, both of Torrance, all of Calif.

[73] Assignee: Hughes Aircraft Company, Los Angeles, Calif.

[21] Appl. No.: 198,420

[22] Filed: Feb. 22, 1994

[51] Int. Cl.[6] ..... H01P 5/12

[52] U.S. Cl. ..... 333/126; 333/135; 333/254

[58] Field of Search ..... 333/110, 114, 125, 126, 333/135, 208, 230, 248, 254

[56] References Cited

U.S. PATENT DOCUMENTS 2,939,093 5/1960 Marié ..... 333/110

3,428,918 2/1969 Matthaei ..... 333/135

*Primary Examiner*—Paul Gensler

*Attorney, Agent, or Firm*—Elizabeth E. Leitereg; Terje Gudmestad; W. K. Denson-Low

[57] ABSTRACT

A right angle waveguide junction for a microwave multiplexer is provided including a step in one of the waveguides for improved electrical response. A rectangular waveguide manifold (10) is coupled to a filter (12) which includes a coupling iris (14) and a circular cavity resonator (16). The circular cavity resonator is a circular waveguide with two ends closed by a metal wall. The structure of the waveguide multiplexer includes a step change (18) in the rectangular waveguide (10) height which controls the electrical response properties of the junction.

4 Claims, 3 Drawing Sheets

MICROWAVE WAVEGUIDE MULTIPLEXER

BACKGROUND OF THE INVENTION

1. Field of the Invention

The present invention relates to waveguide structures for microwave signal transmission and, more particularly, to junction elements for microwave waveguide multiplexers.

2. Background Art

A microwave waveguide multiplexer is a device that either combines or separates microwave signals of different frequencies. A typical waveguide multiplexer is fabricated by joining a filter to a waveguide manifold. The filter is composed of iris coupled waveguide cavity resonators and the waveguide manifold is a length of rectangular waveguide with one end having a metal shorting plate and the other end connected to a transmit or receive port. In the art, junctions are usually formed either by a direct connection of the filter to the broad or narrow wall of the manifold waveguide or by an additional intermediate length of rectangular waveguide connected perpendicular to the manifold and forming a T-junction.

A conventional method of controlling a junction response is to vary the T-junction distance between the filter and the manifold by expensive cut-and-try methods. This requires the development of a breadboard for each design to ensure that the specifications can be met. Also the T-junction separation distance needed can be very large, resulting in a narrow operating frequency band. Since larger microwave devices have a narrower frequency band over which they operate successfully, a junction with a step as provided by the present invention will achieve a wider bandwidth of operation than a T-junction.

SUMMARY OF THE INVENTION

An object of the present invention is to provide a microwave waveguide multiplexer wherein the electrical response properties of the waveguide filter-manifold junction of the multiplexer are controlled by the junction design.

Another object of the present invention is to provide an improved microwave waveguide multiplexer having a right angle junction with dimensions selected for controlling the electrical response properties of the junction.

A further object of the present invention is to provide an improved microwave waveguide multiplexer having a junction including a waveguide manifold and a filter connected by a coupling iris and wherein the electrical response properties of the junction are controlled by a step configuration of the manifold.

DESCRIPTION OF THE INVENTION

Figure 1:
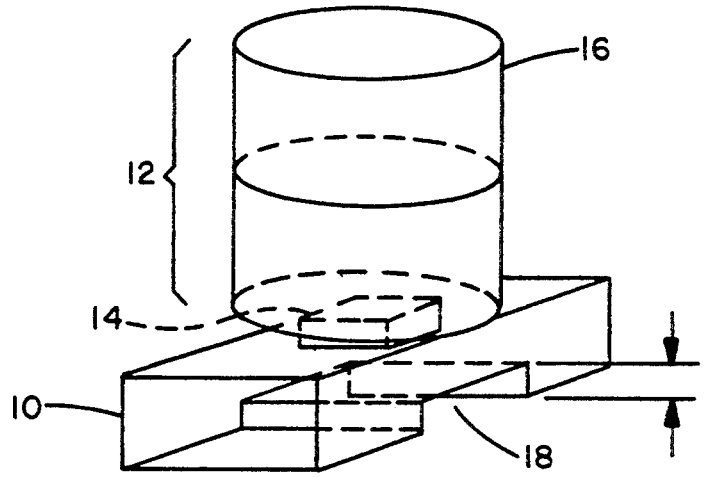
FIG. 1 is a schematic illustration of a microwave waveguide multiplexer according to the principles of the present invention.

Referring to FIG. 1 an embodiment of a right angle junction of waveguides for a microwave multiplexer is shown including a step in one of the waveguides according to the present invention for improved electrical response. A rectangular waveguide manifold 10 is coupled to a filter 12 which includes a coupling iris 14 and a circular cavity resonator 16.

A circular waveguide is a tubular, circular conductor in which transverse electric and transverse magnetic modes propagate. A circular cavity resonator such as resonator 16 is a circular waveguide with two ends closed by a metal wall.

The embodiment of the present invention shown in FIG. 1 includes a step change 18 in the rectangular waveguide 10 height which controls the electrical response properties of the junction.

First, a value of the shunt susceptance B is selected. Typically, it is desired that the structure should have a susceptance B equal to zero over a specified frequency range. The designer then varies the height of the step 18 until the value of the shunt susceptance B is set identically equal to zero at one frequency, normally the center frequency of the specified frequency range, and the shunt susceptance B will then be approximately equal to zero over the rest of the frequency range.

Figure 2:
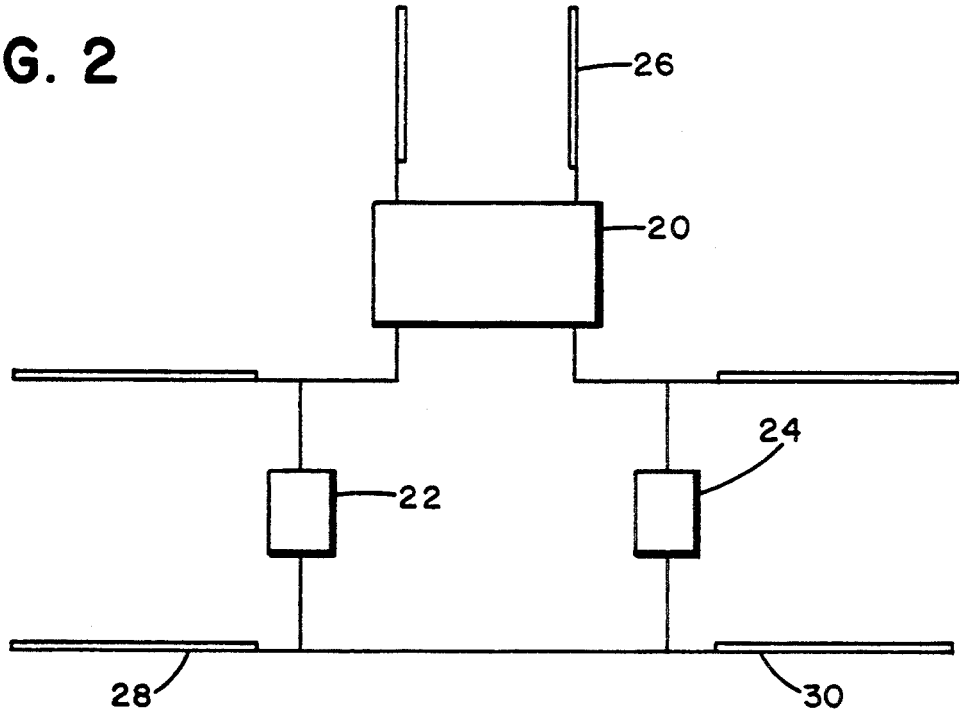
FIG. 2 is a schematic illustration of an equivalent circuit diagram for the junction of the microwave waveguide multiplexer of FIG. 1.

More particularly, the changes of the step height 18 of FIG. 1 produce a resultant response in the form of s-parameters vs. frequency which is converted to the equivalent circuit representation of FIG. 2. The equivalent circuit representation, or model, of the structure of FIG. 1 is composed of an impedance inverter 20 with value K, a pair of shunt susceptances 22 and 24 each with a value of B ohms, a transmission line 26 of length l' and a pair of transmission lines 28, 30 of length l. The impedance inverter 20 models or represents the required coupling K between the filter and the manifold. The susceptances B models or represents the undesired additional elements that can degrade performance. Susceptance B is determined by the height of the step 18, so in the technique of the present invention the desired value of B is set equal to zero and the step height for the decided zero value is determined.

The parameters of the configuration of FIG. 1 and its model of FIG. 2 are obtained and analyzed using electromagnetic simulation software. A software program entitled HP High-Frequency Structure Simulator (HP HFSS) which can carry out the analysis is available from the Hewlett-Packard Company, 1400 Fountaingrove Parkway 2US-P Santa Rosa, Calif. 95403. This program computes the s-parameters of the configuration shown in FIG. 1 at specified frequencies. To complete the analysis one skilled in the art can convert the results into circuit element values for the circuit shown in FIG. 2.

Alternatively, an actual device can be constructed and then analyzed and measured using a microwave network analyzer such as the Hewlett-Packard Company HP 8510.

As a further aid to one skilled in the art in converting the results of the analysis of the structure of FIG. 1 into the circuit of FIG. 2, the analysis program may be coupled to an optimization program such as OSA 90/hope available from Optimization Systems Associates Inc., 163 Watson's Lane, Dundas, Ontario, Canada L9HGL1. In such optimization program the elements of the circuit shown in FIG. 2 can be automatically varied until their response matches the computed results obtained via simulation such as by using HP HFSS.

Figure 3:
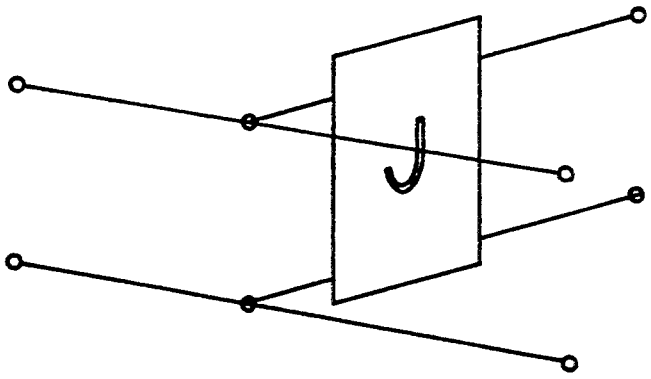
FIG. 3 is a circuit model for a filter-to-manifold with an admittance inverter.

The value K is computed from known circuit design methods for waveguide or transmission line manifold multiplexers. A program for computing this value of K is obtaining using the teachings in "Design of General Manifold Multiplexers" by J. David Rhodes and Ralph Levy, IEEE Transactions on Microwave Theory and Techniques, Vol. MTT-27, No. 2 Feb. 1979, pp 111–123. In this publication, the circuit model for a filter-to-manifold junction is an admittance inverter of value J, coupled in parallel to a transmission line or waveguide manifold as shown in FIG. 3. The configuration from the Rhodes et al publication shown in FIG. 3 is the dual of that used in the design of the junction shown in FIG. 2 of the present invention, a series coupled impedance inverter of value K. Thus, numerically a value of J computed in accordance with the teaching of the Rhodes et al publication equals the value of K used in the circuit of FIG. 2. Impedance and admittance inverters are common circuit elements used in Microwave filter design. See "Microwave Filters, Impedance-Matching Networks and Coupling Structures" by George L. Matthaei, Leo Young, and E. M. T. Jones, McGraw-Hill, New York, N.Y., 1964, pp 431–440.

Having obtained the necessary parameters for the circuit model of FIG. 2, the dimensions of the actual manifold waveguide device depicted in FIG. 1 can be obtained by varying the slot lengths and the step height. The structure of FIG. 1 can be substantially the same as the circuit design of the filter-to-manifold function of FIG. 2.

Providing the step 18 of the determined height in the waveguide manifold has the same effect on the structure response characteristics as separating the T junction distance between the filter 12 and the manifold 10, but has the advantages of smaller size and wider bandwidth. Thus, the use of the waveguide step 18 becomes important in communications satellite applications to permit an increase in the number of channel filters that can be attached to a manifold, and to improve the filter responses.

Figure 4:
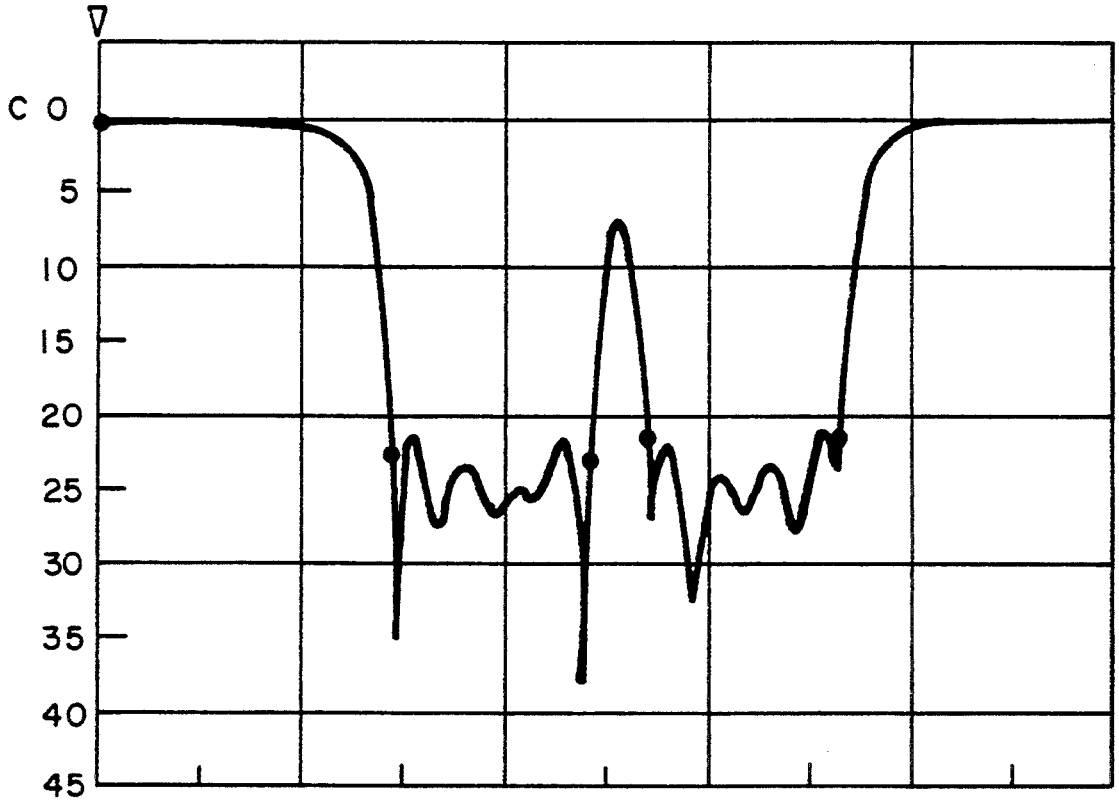
FIGS. 4, 5 and 6 are curves illustrating the electrical response of the microwave waveguide multiplexer of FIG. 1.
Figure 5:
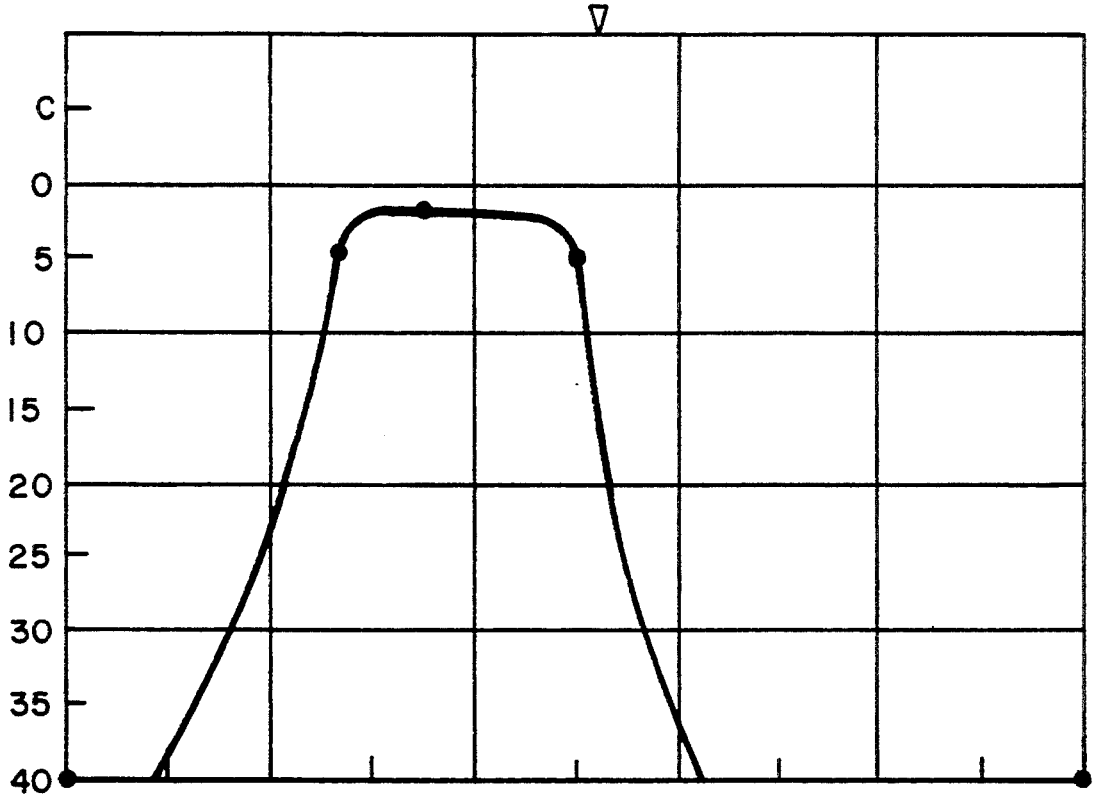
Figure 6:
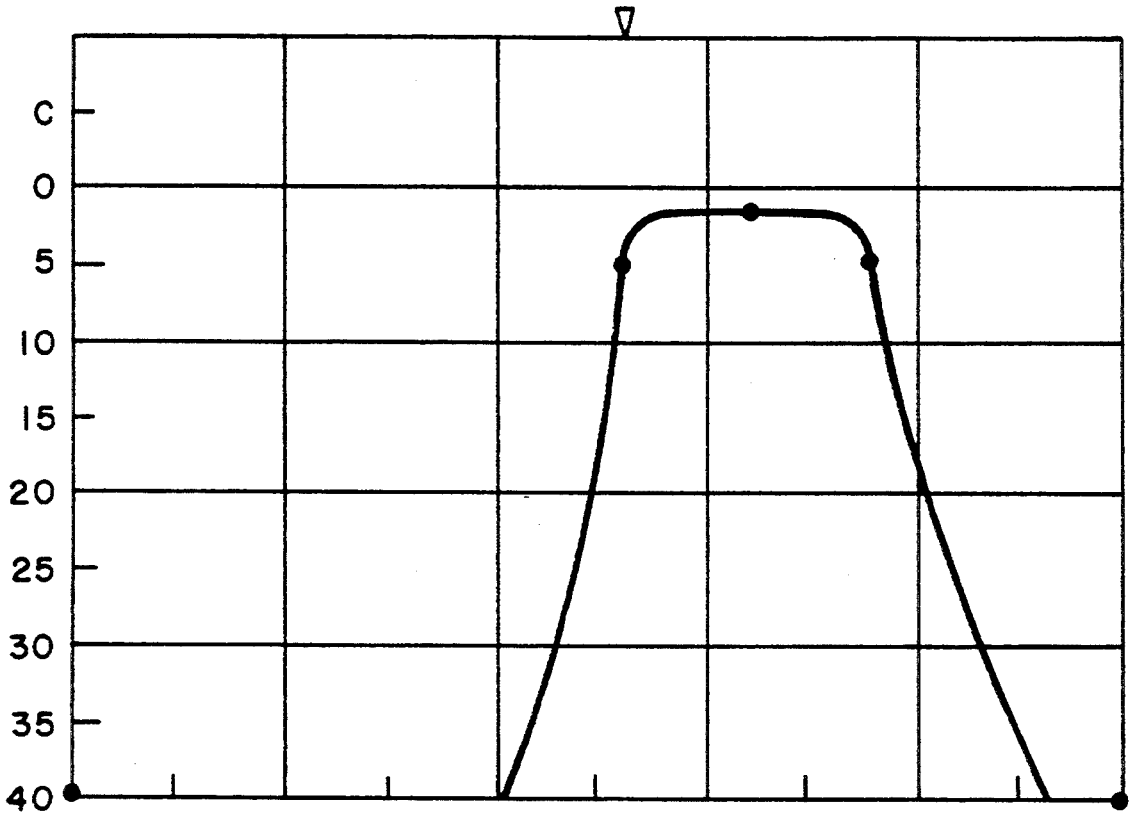

FIGS. 4, 5 and 6 show the measured response of a two bandpass channel multiplexer for first and second bandpass channels using the modified junction of the present invention. FIG. 4 shows the common port return loss; FIG. 5 shows the insertion loss of the first bandpass channel; and FIG. 6 shows the insertion loss of the second bandpass channel. The measured responses agree with predictions based on the design model that assumes B is identically zero.

By increasing the number of channel filters on a manifold, two multiplexers that cover part of a frequency band can be replaced, typically every other bandpass channel (an odd-even multiplexer), with a single multiplexer that covers the entire band (a contiguous multiplexer). This allows for replacing a dual feed transmit antenna with a single feed antenna and thereby reducing the weight of the satellite.

The improved filter response permits more stringent system requirements to be achieved and elimination or reduction of the likelihood of out-of-spec conditions occurring.

While the invention has been described in connection with a preferred embodiment, it is not intended to limit the scope of the invention to the particular form set forth, but, on the contrary, it is intended to cover such alternatives, modifications, and equivalence as may be included within the spirit and scope of the invention as defined in the appended claims.

We claim:

1. A method for controlling the electrical response properties of a waveguide junction, between a filter means and a waveguide multiplexer manifold structure by reducing the height X of the waveguide junction by a step amount h such that the resultant height of the manifold structure is X−h for the length z of the waveguide junction comprising the steps of:

step 1, providing a calculated equivalent circuit: model for said waveguide multiplexer manifold structure including an impedance inverter element including first and second pairs of terminals and having a coupling value of K, a pair of shunt susceptance elements each having a value of B ohms, a first shunt susceptance element connected to one of said second pair of terminals of saint impedance inverter element, and a second shunt susceptance element connected to the other of said second pair of terminals of said impedance inverter element, a first transmission line element having a length l connected across said first and second shunt susceptance elements and a second transmission line element having a length l′ connected to said first pair of terminals of said impedance inverter element, wherein said coupling value K is the required coupling between the filter means and the manifold structure and said susceptance elements B represent the additional elements of the waveguide junction that degrade performance, step 2, setting the value of B of said susceptance elements of said calculated equivalent circuit to zero for a specified frequency range, step 3, determining the height h of the waveguide junction step for the setting of said zero value of B susceptance elements.

2. A method for controlling the electrical response properties of a waveguide junction according to claim 1 wherein the providing of a calculated equivalent circuit model includes performing a structure simulation technique wherein the S-parameters of the said waveguide multiplexer manifold structure are determined for specified frequencies, and the elements of said circuit model are determined from said S-parameters.

3. A method for controlling the electrical response properties of a waveguide junction according to claim 2 wherein setting the value of B of said susceptance elements to zero in step 2 of claim 1 is carried out varying the step height parameter h until the value of said shunt susceptance elements B is set equal to zero at the center frequency of said specified frequency range.

4. A method for controlling the electrical response properties of a waveguide junction according to claim 3 wherein said determining the height h of said waveguide junction step in step 3 of claim 1 includes determining the S-parameters of said waveguide multiplexer manifold structure for said step height at which said shunt susceptance elements B is equal to zero as determined in claim 1, step 2.

* * * * *